United States Patent [19]

Goulter

[11] Patent Number: 4,796,648

[45] Date of Patent: Jan. 10, 1989

[54] ERGONOMIC CANE HAVING OVAL, TAPERED SHORT HANDLE AND TRIANGULAR SHANK FOR EASIER CONTROL WITH MORE COMFORTABLE GRIP

[76] Inventor: Victor H. Goulter, 485 Molimo Dr., San Francisco, Calif. 94127

[21] Appl. No.: 30,120

[22] Filed: Mar. 26, 1987

[51] Int. Cl.[4] ..... A45B 1/00

[52] U.S. Cl. ..... 138/65; D3/7; D3/9

[58] Field of Search ..... 135/17, 18, 65, 66–74; D3/7, 8, 9, 12; 273/67 R; 248/155

[56] References Cited

U.S. PATENT DOCUMENTS

| | | | |
|---|---|---|---|
| D. 83,952 | 4/1931 | Carley | D3/7 |
| 137,233 | 3/1873 | Oberndorf, Jr. | 135/65 |
| 140,825 | 7/1873 | Harnach | 135/65 |
| D. 229,728 | 12/1973 | Thomas | D3/9 |
| 1,701,866 | 2/1929 | Soriente | 135/65 |
| 2,360,240 | 10/1944 | Kjellstrom | 135/65 |
| 2,561,228 | 7/1951 | Richey | 135/65 |

FOREIGN PATENT DOCUMENTS

| | | | |
|---|---|---|---|
| 1600 | of 1862 | United Kingdom | 135/65 |
| 2873 | of 1869 | United Kingdom | 135/65 |

*Primary Examiner*—Robert A. Hafer
*Assistant Examiner*—Charles H. Sam
*Attorney, Agent, or Firm*—David Pressman

[57] ABSTRACT

An ergonomic cane comprises a shank (20) and, at one end of the shank, a handle part (22) which is shaped like a pistol grip. The shank has a triangular configuration (FIG. 3) with substantially flat sides (56), which may be slightly concave (FIG. 4). The handle grip extends at a generally right angle from the shank, has an oval cross section (FIG. 7), has a plurality of finger grips (44) extending up from the lower edge thereof, is wider adjacent the shank than at its free end (38), and its lower side makes an obtuse angle with the shank. A hanging strap (48) is attached to the handle grip. By virtue of the triangular configuration of the shank, the cane can be made of lightweight material, such as redwood, yet has ample strength. The pistol grip handle, its angle of joinder with the shank, and the flat sides of the shank provide a handle which can be held with three fingers and a shank which can be held by the extended thumb and forefinger (FIG. 10) so that the cane can be far more easily held, pointed, and controlled.

9 Claims, 4 Drawing Sheets

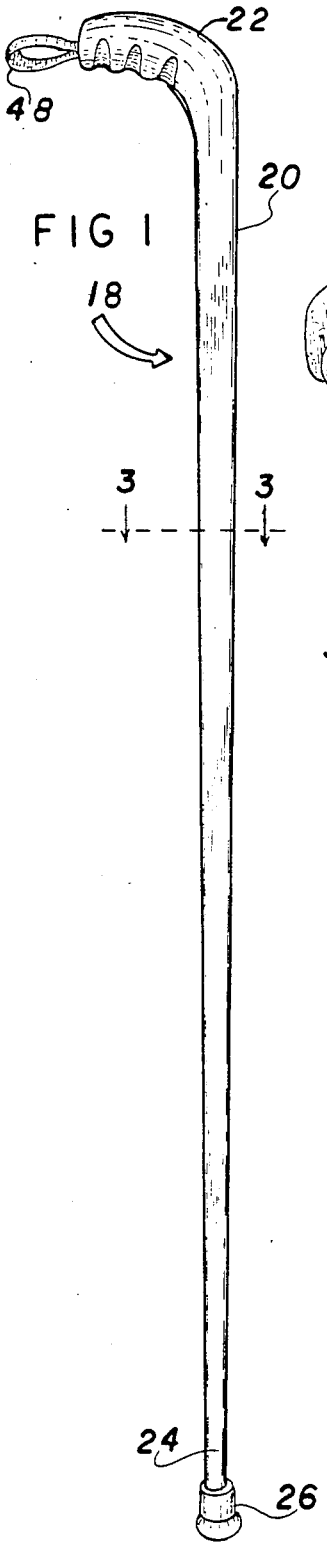
FIG 1
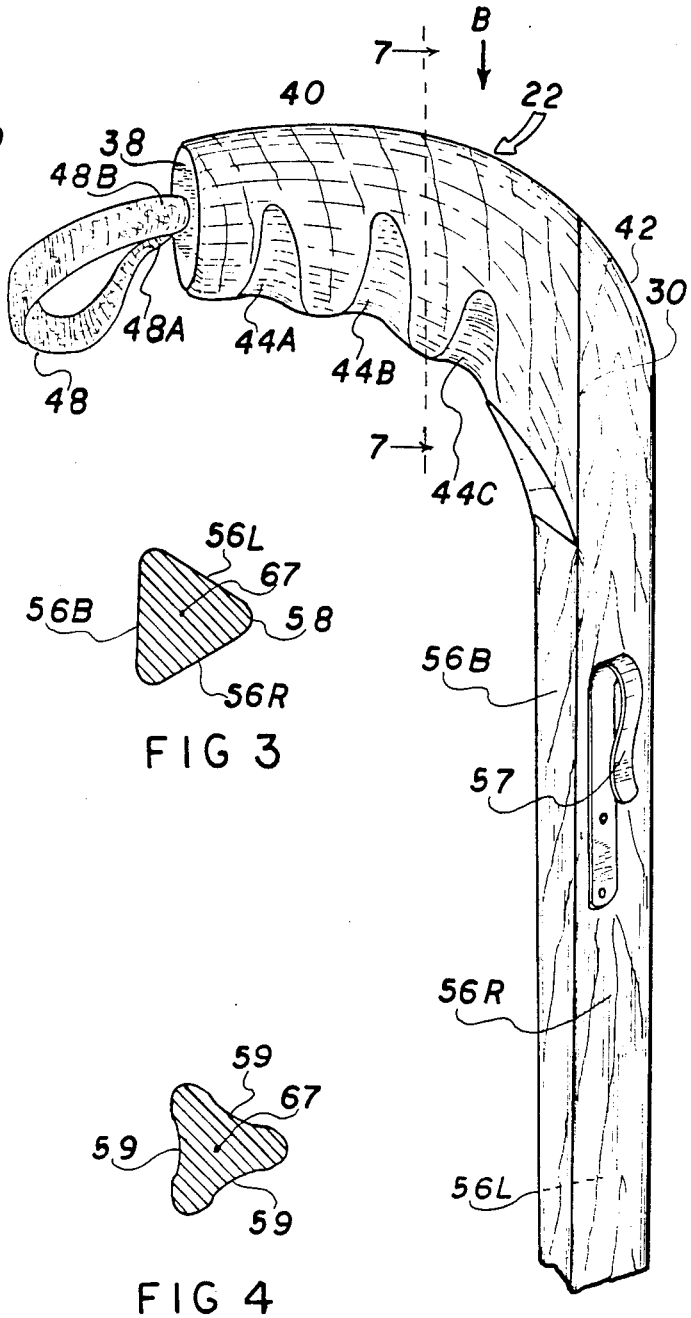
FIG 2
FIG 3
FIG 4

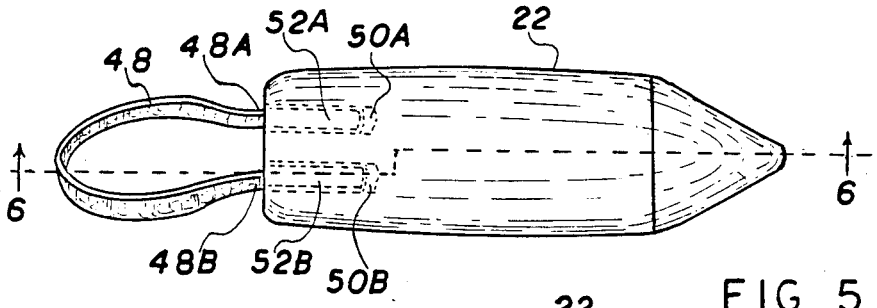
FIG 5
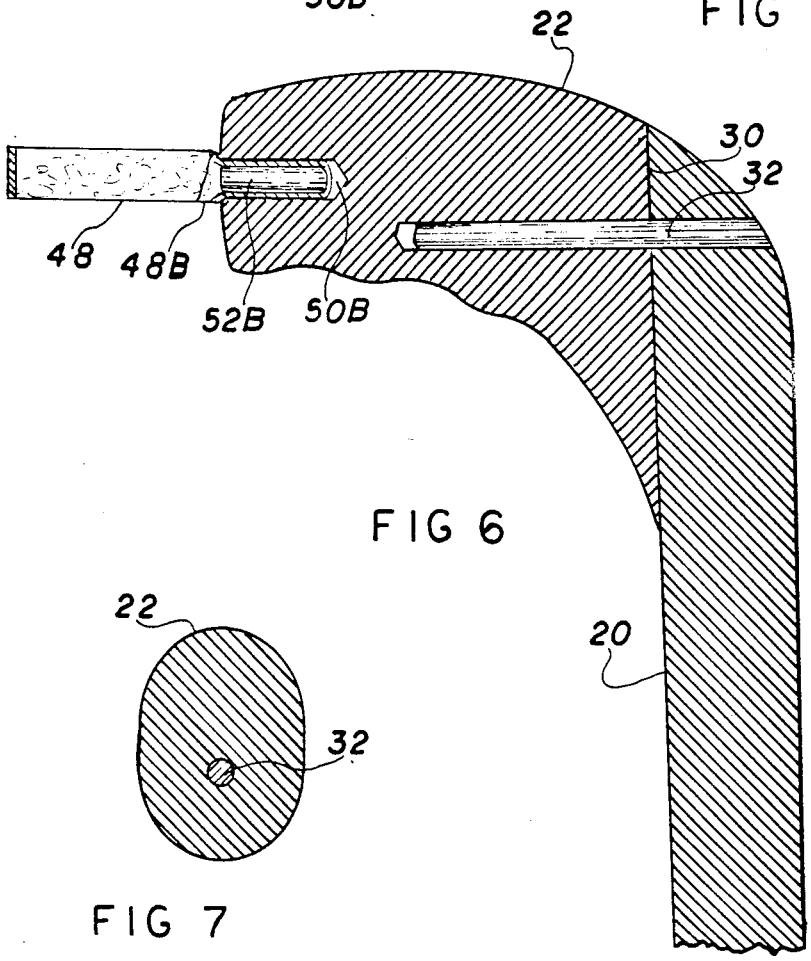
FIG 6
FIG 7

ERGONOMIC CANE HAVING OVAL, TAPERED SHORT HANDLE AND TRIANGULAR SHANK FOR EASIER CONTROL WITH MORE COMFORTABLE GRIP

BACKGROUND

1. Field of Invention

This invention relates to a walking cane, in particular a lightweight cane incorporating an ergonomically-designed handle.

2. Description of Prior Art

In the past, walking canes have been made of heavy materials, such as solid cane, natural brushwood, colored exotic woods, odd shaped stems of tree limbs or roots, metal tubing, etc. Some canes have artistically carved handles, sometimes representing heads of animals or reptiles, or even the handles of guns. While these designs may be artistic in appearance, they do little to make the cane comfortable and in many cases they actually make the cane very difficult to use. The added weight also becomes a burden to carry around.

Some canes are made from lightweight materials, such as aluminum, magnesium or alloys, carbon fiber materials, etc, and some even incorporate a length adjusting mechanism. While these benifit the user by their reduced weight, the user resents the unattractive metallic look and their lack of aesthetic appeal or artistic qualities.

Most canes generally have a hook-type handle, i.e. a handle which makes the cane resemble an inverted "J". While the hooktype handle provides a means to hang the cane when not in use or hang it onto one's arm when both hands are being used, such as while using a wallet or handbag, the hook-type handle is neither comfortable nor functional in use while walking. This is because one's hand tends to slip around the curve, either to the shaft or to the free end of the hook part, thereby reducing one's ability to control the cane from moving fore or aft. Also due to the wide arc of the hook-type handle and its relative position to the stem, it is necessary to place the entire hand and its grip distal from the center line of the cane's stem. In use this creates an ergonomically maladaptive relationship between user and cane, resulting in diminished comfort and benefit due to muscle fatigue of hand, forearm and shoulder. Also the hook-type handle permits the cane to move sideways, that is towards or away from the user, making it necessary to apply intensive grip on the handle to control the cane. Since such a grip cannot be constantly maintained for long periods, the user tends to loose his or her grip and consequently control of the cane without awareness. This has caused many falls and resulting injuries to the user. The lack of control is particularly prone to people with arthritic hands, or with deformed hands or limbs.

Some have attempted to design around this problem by using rubber handle bar grips, such as used on bicycles. While these assist in maintaining the grip and improving fore and aft control of the cane, side-to-side control is poor due to the generally circular cross section of the handle. Also, rubber tends to make the hand perspire and feel uncomfortable, which also contributes to loss of control.

I have also noted that most canes are relatively large or heavy. Many have large and or long handles or overly big hook-type handles. They are made this way to provide adequate strength to support the user's weight during use. Therefore, maximum comfort and benefit is not obtained since the user must carry around a heavier-than-necessary cane. While this may not be of great detriment to a healthy or even slightly handicapped person, it is a great detriment to old and feeble users.

OBJECTS AND ADVANTAGES

Accordingly I claim the following objects and advantages of my invention: to provide a cane which can be made of an attractive lightweight material, yet still be pleasing to the feel and appealing to the eye, to provide a cane which has an ergonomically designed handle which is comfortable in use and which does not tend to make the hand sweat, to provide a handle which does not require a tight grip for the user to maintain back and forth or side-to-side control, to provide a cane which is not a burden to carry and use, even for the aged and feeble, yet which is still attractive in appearance, and to provide a cane which does not require a difficult-to-control hook-type grip. Also to provide a cane in which the hand is positioned more directly over the center line of the cane's stem, to provide a cane in which the handle is smaller, therefore requiring less space and cost in packaging, storing, and shipping. Further objects and advantages are to provide a cane which can be used as an effective defence weapon, to provide a useful walking stick, i.e., a useful walking cane, either in urban, rural, or even in mountainous areas for use by users who are perfectly fit and healthy, to provide a cane which can easily be decorated, to provide a cane which can be used by young and old alike without fear of being looked upon as a cripple or as incapacitated and to provide a cane which is far easier to control since one can guide the cane by pointing one's index finger, which itself can be kept in a very comfortable position. Readers will find further objects and advantages of the invention from a consideration of the ensuring description and the accompanying drawings.

DRAWING FIGURES

FIG. 1 is a perspective view of a cane according to the invention.

FIG. 2 is a detailed perspective view of the cane's handle and part of its stem.

FIG. 3 is a cross sectional view of the stem taken along the lines 3—3 of FIG. 1.

FIG. 4 shows an alternative cross sectional configuration of the stem.

FIG. 5 is a top view taken in the direction of arrow 'B' of FIG. 2.

FIG. 6 is a cross sectional view taken along the lines 6—6 of FIG. 5.

FIG. 7 is a cross sectional view taken along the lines 7—7 of FIG. 2

Figures 8, 10:
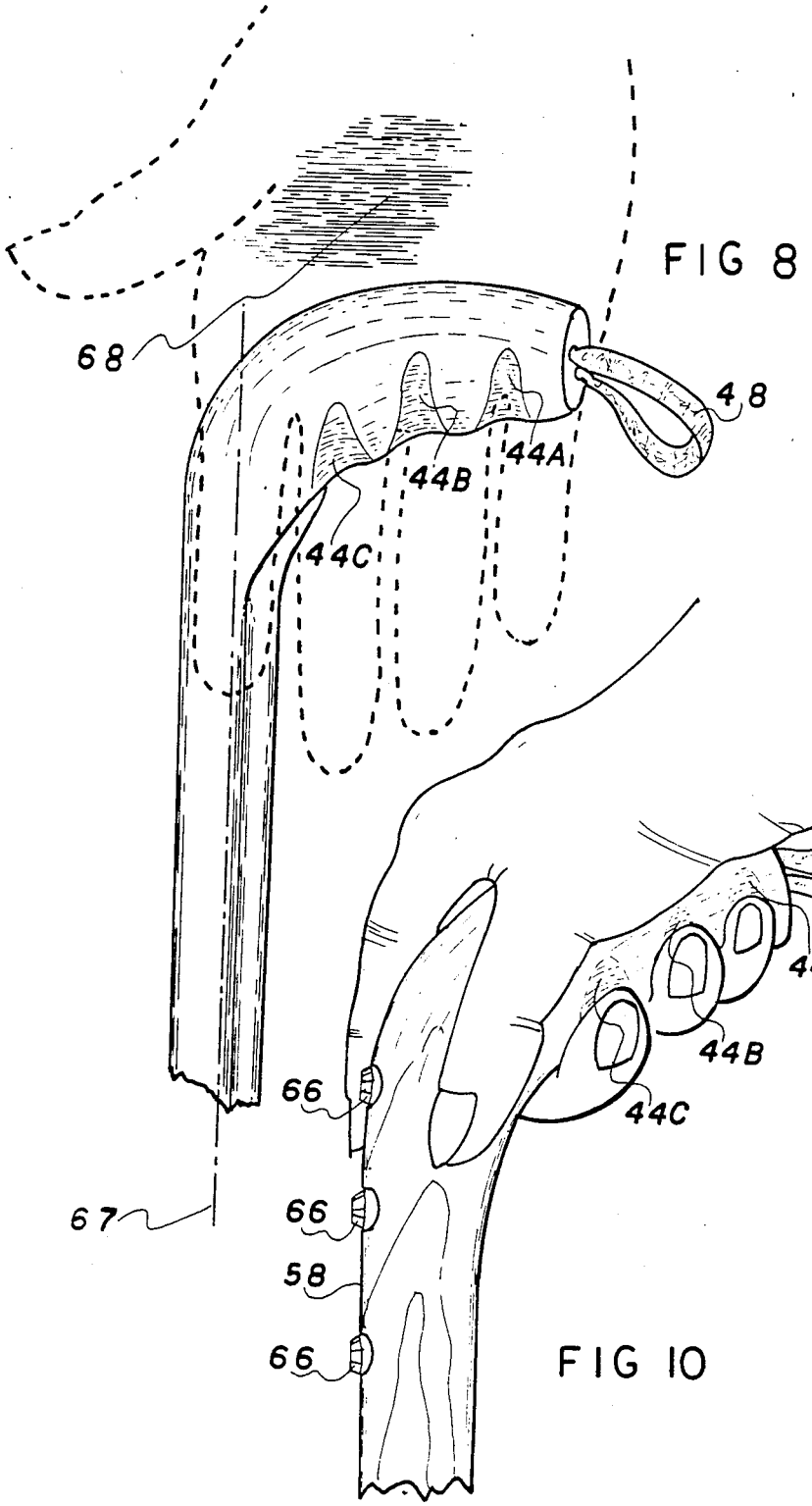
FIG. 8 is part perspective, part phantom view of a hand and the cane's handle and stem.
FIG. 10 is a perspective view of the top part of the cane and a hand wherein the cane has decorative Jewels on its stem.

Reference Numerals cane
stem
handle
lower end
rubber tip
upper stem
joint line
dowel
drilled hole
handle end
crest
top end
A, 44B, 44C finger grips
loop or cord
A, 48B cord ends
A, 50B holes
A, 52B pins
flat side
hook
rounded edge
flutes
cross section
jewels
center line
weight supporting part

DESCRIPTION

FIG. 1 shows a cane 18 according to the preferred embodiment of the invention. Cane 18 preferably is made of California redwood or Australian red cedar, but also can be made of plastic, metal tubing, or a carbon fiber composite material, or even a sturdy skin casing material such as fiberglass which is then filled with a supportive material such as styrofoam, or any other suitable material or combination of materials.

Cane 18 has an elongated stem 20 which tapers downward to a lower end 24 where it is fitted with a removable rubber non-slip tip 26. A handle 22 is attached to the top end of stem 20. The length of the cane can be shortened to individual by removing tip 26, cutting off a suitable length from the bottom end of stem 20, and replacing stem 26.

Handle 22 is shaped somewhat like a pistol grip. It is glued to the upper end of stem 28 along a joint line 30. Joint line 30 is strengthened by reinforcing dowel 32 (FIG. 6) fitted into aligned holes in the stem and handle. The top surface of handle 22 curves slightly upward (FIG. 2) from its free end 38 (distal from stem 20) to a crest 40 about midway between end 38 and joint line 30. Then handle 22 curves downward in an increasingly arced curve until it merges with top 42 of stem 20. Handle 22 is notched with three wide grooves 44*a*, 44B, and 44C on its lower side; these grooves extend about halfway up on each side of handle 22 so as to provide three finger grips. As shown best in FIGS. 1, 6, and 8, the lower side of handle 22 curves downward more rapidly than the upper side thereof, whereby the handle's thickness increases toward joint line 30 so that the vertical dimension of the handle, measured parallel to and adjacent the shank, is at least twice its vertical dimension at its free end. Thus the lower side of handle 22 and the adjacent portion of side 56B of the shank forms an arc with a greater radius of curvature or a wider angle than does top 42 and the adjacent (front) edge of the shank. The increased thickness conforms to the increased length of the little, ring, and middle fingers which will rest in finger grips 44A, 44B, and 44C respectfully when the cane is in use, as shown in FIG. 10. As shown in the cross sectional view of FIG. 7, handle 22 has an oval cross section; the height (but not the width) of the oval increases toward stem 20. Note that the lower surface of handle 22 makes an obtuse angle with stem 20 and then angles to the horizontal to make a normal angle with the stem.

The handle is preferably 70 to 80 mm ($2\frac{7}{8}$ to $3\frac{3}{4}$ in) long (about the width of two thirds of a human hand or that part of the hand to which the little, ring, and middle finger are joined,) and terminates in free end 38. The remaining one third width of the hand to which the forefinger and thumb are Joined occupy the top end 42 of stem 20. Since the length of handle 22 and width of stem 20 combined is about the width of a human hand, that is 90 to 100 mm (3.5 to 4 in), less space is required to package, store, and ship the cane.

A hanging cane or loop 48 extends from end 38 of handle 22. Cord 48 preferably is made of soft leather or any other suitable material, is about 10 mm ($\frac{3}{8}$ in) wide and forms a loop about 40 mm to 60 mm (1.5 to 2.5 in) long. Its ends 48A and 48B are secured in respective holes 50A and 50B (FIG. 5) in end 38 of handle 22 by pins 52A and 52B which are pressed and or glued into position.

Stem or shank 20 is of triangular shape as shown in FIG. 3. It has three flat, equal-in-width sides 56B (back), 56R (right), and 56L (left) about 25 mm (1 in) wide at the top end 42 with three rounded edges, such as 58. The stem tapers down to about 15 mm to 20 mm ($\frac{5}{8}$ to $\frac{3}{4}$ in) wide at tip 24. Alternatively, the sides of stem 20 can be concave as indicated at 59 (FIGS. 4 and 11) to provide flutes or grooves for part of the upper end of stem 20 or for the entire length of the stem. These are preferably less than 2 mm (3/32 in) deep and 10 mm ($\frac{3}{8}$ in) wide at the top end and gradually taper in depth and width to substantially zero depth at tip end 24.

On a man's walking cane, a hook 57 (FIG. 2) may be attached to side 56R or 56L of stem 20 near the top end and at a suitable distance ( e.g. 75 mm) from the cane's handle so as to not come into contact with the hand when the cane is in use.

One or more genuine or imitation jewels or other objects 66 (FIGS. 10 and 11) may be fitted onto edge 58 at the front of stem 20, starting at top portion 42 and extending as far down as is desired for the purpose of identification and enhancing the cane's appearance.

Operation

The cane of FIG. 1 will give all users greater assistance than prior art canes due to the combination of a comfortable handle 22 (especially with finger grips 44A, 44B, and 44C) and flat sides 56R and 56L. Also the fact that the cane is lightweight and has an attractive material and will give the user added control and will make use pleasurable. The cane can be held by either hand, with the little, ring, and middle finger, engaging finger grooves 44A, 44B, and 44C in that order The index or forefinger is pointed downward along one flat surface (or concave) side (56R for right handed users) of stem 20 while the thumb points downward along the other forward flat side (56L) as shown in FIG. 10. These flat sides enable the user to comfortably rest the index finger and thumb so as to accurately and easily control the side to side movement of the cane with the thumb and forefinger, and to a lesser degree with the first three fingers. Also the user can control more accurately and easily fore and aft movement by the first three fingers since these are engaged in grooves 44A, 44B, and 44C; also the forefinger and the thumb aide to a lesser degree.

Figure 11:
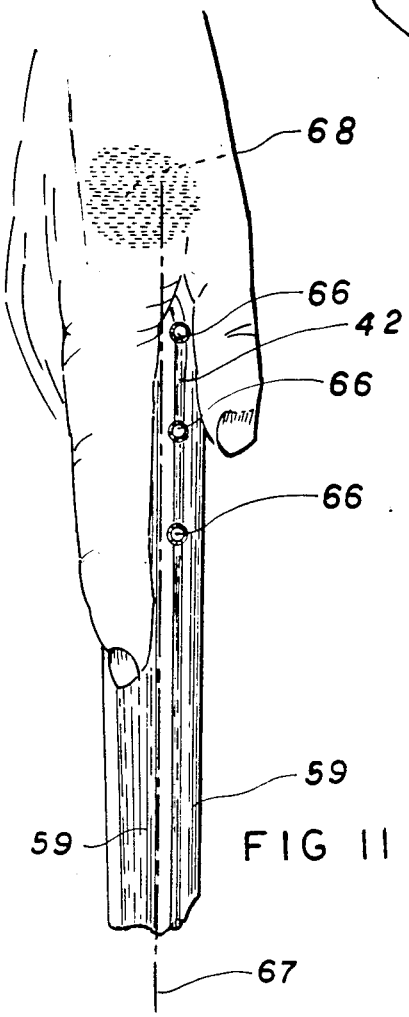
FIG. 11 is a perspective view of the top part of the cane and a hand holding and directing the cane in actual use.

I have found that a light grip by the hand is sufficient to manipulate the cane at all times and conditions of use, and in all directions. The fact that the forefinger is extended along a flat (or concave) side of the cane's stem, and it points in the direction of the stem (as shown in FIG. 11), enables the user to control the cane precisely and point it wherever desired merely by pointing the index finger to wherever he or she desires to place the tip of the cane. The flat or concave sides of the cane's stem thus cooperate with the pistol grip handle to provide a more graspable and controllable cane.

In actual use center line 67 of stem 20 points in the general direction of the weight supporting part 68 (FIGS. 8 and 11) of the hand holding the cane, i.e., between the center of the palm of the hand and the ball of the thumb.

Figure 9:
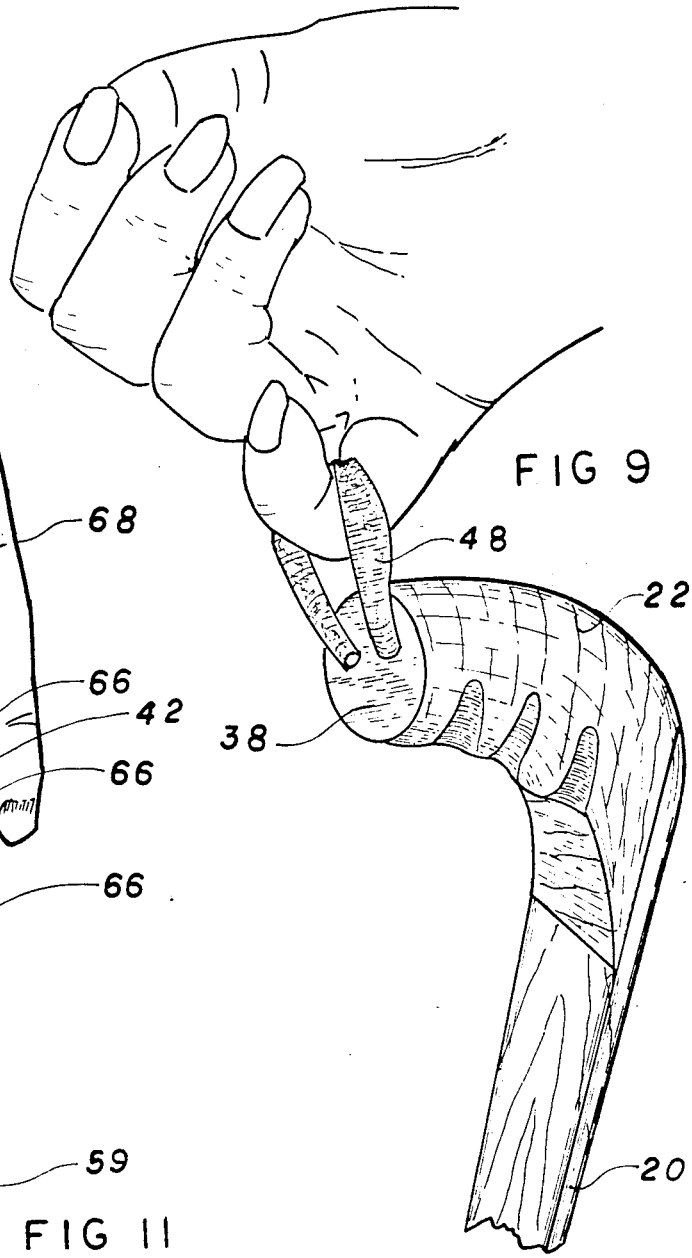
FIG. 9 is a perspective view of a hand, top part of the cane, and a hanging loop in actual use.

When one needs to use both hands, as in opening a wallet and handling money, the cane is hung on the little finger by strap or cord 48 (FIG. 9), With a man's cane, he can choose to hang the cane from his pocket using hook 57.

The cane is light in weight yet strong, since it is made from a relatively light wood, redwood, yet has maximised rigidity due to its triangular shape. Thus the little finger is not overtaxed even if it is used to carry the cane for long periods.

The cane can also be used for self defence by gripping the lower part of stem 20 and swinging the cane so that handle end 38 is directed at any assailant.

Jewels 66 (FIGS. 10 and 11) add attractiveness to the cane and also help the owner to identify his or hers from others when several are together. For this purpose the jewels can be arranged in a design which is unique to each user, e.g., one design might be red-white-blue. The cane's attractiveness can be further enhanced by engraving or burning the words "CALIFORNIA REDWOOD" and the mark "WALKING COMPANION" on its side or attaching these words on a decorative plate.

SUMMARY, RAMIFICATIONS, AND SCOPE

Accordingly it is seen that, according to the invention, I have provided a cane which is ergonomic in that it is designed for easier holding and menipulation. Specifically, the cane can be made of a relatively lightweight material, such as redwood, yet it has greater strength due to its triangular shape. It has a very attractive appearance without any sacrifice in utility. It has a handle which can be easily controlled and has no tendency to move to either side or fore and aft, as do prior-art canes with curved handles. It is far easier to use by persons with feeble or arthritic grips. By virture of its pistol-like grip and the flat sides on its shank or stem, it can be held with three fingers of the hand with the index finger and thumb on the flat sides of the shank and thereby can be pointed and controlled far more accurately and readily.

While the above description contains many specificities, these should not be construed as limitations on the scope of the invention, but as examplifications of the presently-preferred embodiment thereof. For example, the shank can have a square, non-square rectangular, pentagonal, or other polygonal cross section, at some sacrifice in strength, the flat or concave sides of the shank can extend only partway down from the handle (in this case the bottom part of the shank could be circular in cross section), the finger grooves on the handle can be eliminated or replaced by a knurled surface, the handle can have longitudinal grooves on top and transverse grooves on the bottom, the handle grip can have a circular or rounded rectangular instead of oval cross section, and the handle grip can be joined to the shank by a more abrupt (instead of curved) junction.

Thus the scope of the invention should be determined by the appended claims and their legal equivalents, and not by the examples given.

I claim:

1. An ergonomic cane, comprising:

an elongated shank having a lower end and an upper end, a handle grip attached to said upper end of said shank, the portion of said shank which extends at least part way down from and adjacent to said handle grip having a triangular shape with three sides, said handle grip extending generally normal to said shank and out from said shank about 70 to 80 millimeters so as to be about two thirds the width of an adult human hand and having a free end at the part thereof distal from said shank, said handle grip having a generally oval cross section which increases in area from the free end of said handle grip to the portion of said handle grip which joins said shank, the height of said handle grip measured parallel to and adjacent said shank being at least twice the height thereof at said free end, such that said handle grip has a larger cross section adjacent said shank than at said free end thereof, the lower side of said handle grip which is adjacent said shank extending from said shank at a relatively large obtuse angle with said shank, the upper side of said handle grip which is adjacent said shank extending from said shank at a relatively small obtuse angle with said shank, the part of said lower side of said handle grip beyond said part which is adjacent said shank curving from said relatively large obtuse angle with said shank to a generally normal angle to said shank, said handle grip having a plurality but no more than three generally parallel finger grooves adjacent and extending up from said lower side thereof, whereby said handle grip can be grasped with the thumb and first three fingers of a hand in a very comfortable manner due to the oval shape and increasing size of said handle grip and the index finger and end of the thumb can be comfortably rested on a respective two of the three sides of said shank to help control and direct said cane with precision.

2. The cane of claim 1 wherein said sides of said shank are slightly concave.

3. The cane of claim 2 wherein said shank has a triangular cross section for the entire length thereof.

4. The cane of claim 1 wherein said shank has a triangular cross section for the entire length thereof.

5. The cane of claim 4 wherein said sides of said shank are slightly concave.

6. The cane of claim 1 wherein said handle grip has a carrying strap attached thereto.

7. The cane of claim 1, further including a hanging hook attached to said shank.

8. The cane of claim 1 wherein the shank of said cane has at least one decorative member attached thereto.

9. The cane of claim 1 wherein the width of said handle grip as measured substantially perpendicular to said shank and to the axis of said handle grip is substantially uniform throughout the length of said handle grip.

* * * * *

UNITED STATES PATENT AND TRADEMARK OFFICE

CERTIFICATE OF CORRECTION

PATENT NO. : 4,796,648

DATED : January 10, 1989

INVENTOR(S) : Victor H. Goulter

It is certified that error appears in the above-identified patent and that said Letters Patent is hereby corrected as shown below:

Col.3, line 2,change "cane" to --18 cane--
Col.3 line 3,change "stem" to --20 stem--
Col.3, line 4,change "handle" to --22 handle--
Col.3, line 5, change "lower end" to --24 lower end--
Col.3, line 6, change "rubber tip" to --26 rubber tip--
Col.3, line 7, change "upper stem' to --28 upper stem--
Col.3, line 8, change "joint line" to --30 joint line--
Col.3, line 9, change "dowel" to --32 dowel--
Col.3, line 10, change "drilled hole" to --34 drilled hole-
Col.3, line 11, change "handle end" to --38 handle end--
Col.3, line 12, change "crest" to --40 crest--
Col.3, line 13, change "top end" to --42 top end--
Col.3, line 14, change "A,44B,44C finger grips" to --44A, 44B, 44C finger grips--
Col.3, line 15, change "loop or cord" to --48 loop or cord--
Col.3, line 16, change "A,48B cord ends" to--48A, 48B cord ends--

UNITED STATES PATENT AND TRADEMARK OFFICE

CERTIFICATE OF CORRECTION

PATENT NO. : 4,796,648

DATED : January 10, 1989

INVENTOR(S) : Victor H. Goulter

It is certified that error appears in the above-identified patent and that said Letters Patent is hereby corrected as shown below:

Col.3, line 17, change "A,50B holes" to--50A, 50B holes--
Col.3, line 18, change "A,52B pins" to--52A, 52B pins--
Col.3, line 19, change "flat side" to--56 flat side--
Col.3, line 20, change "hook" to --57 hook--
Col.3, line 21, change "rounded edge" to--58 rounded edge--
Col.3, line 22, change "flutes" to --59 flutes--
Col.3, line 23, change "cross section" to --62 cross section--
Col.3, line 24, change "jewels" to --66 jewels--
Col.3, line 25, change "center line" to --67 center line--
Col.3, line 26, change "weight supporting part" to--68 weight supporting part--

Signed and Sealed this

Seventeenth Day of October, 1989

*Attest:*

DONALD J. QUIGG

*Attesting Officer*

*Commissioner of Patents and Trademarks*